US006024068A

United States Patent [19]

Nakase et al.

[11] Patent Number: 6,024,068

[45] Date of Patent: Feb. 15, 2000

[54] WATERCRAFT ENGINE CONTROL

[75] Inventors: Ryoichi Nakase; Shigeyuki Ozawa; Keiichi Hiki, all of Iwata, Japan

[73] Assignee: Yamaha Hatsudoki Kabushiki Kaisha, Iwata, Japan

[21] Appl. No.: 09/038,457

[22] Filed: Mar. 11, 1998

Related U.S. Application Data

[63] Continuation-in-part of application No. 08/977,264, Nov. 24, 1997, abandoned.

[30] Foreign Application Priority Data

Nov. 22, 1996 [JP] Japan ..... 8-327621

[51] Int. Cl.[7] ..... F02B 77/00

[52] U.S. Cl. ..... 123/198 D; 123/198 DB; 123/198 DC

[58] Field of Search ..... 123/198 D, 198 DB, 123/198 DC; 440/900

[56] References Cited

U.S. PATENT DOCUMENTS

| | | | |
|---|---|---|---|
| 3,749,447 | 7/1973 | Renaud | 200/43.07 |
| 3,989,002 | 11/1976 | Peterson | 114/270 |
| 4,250,358 | 2/1981 | Gilbertson | 200/52 R |
| 4,539,452 | 9/1985 | Draxler et al. | 200/334 |
| 4,898,132 | 2/1990 | Kanno . | |
| 4,917,061 | 4/1990 | Nagakura . | |
| 4,949,684 | 8/1990 | Gohara . | |
| 5,041,040 | 8/1991 | Jones et al. | 441/69 |
| 5,069,174 | 12/1991 | Kanno . | |
| 5,144,300 | 9/1992 | Kanno . | |
| 5,167,550 | 12/1992 | Nielsen | 440/84 |
| 5,190,148 | 3/1993 | Williams | 200/43.08 |
| 5,282,437 | 2/1994 | Basto | 114/345 |
| 5,593,330 | 1/1997 | Kobayashi . | |
| 5,615,645 | 4/1997 | Kanno | 123/73 C |
| 5,730,098 | 3/1998 | Sasaki et al. | 123/198 DB |
| 5,894,087 | 4/1999 | Ohtuka et al. | 73/185 |
| 5,934,958 | 8/1999 | Ochiai | 440/89 |

*Primary Examiner*—Noah P. Kamen
*Assistant Examiner*—Hai Huynh
*Attorney, Agent, or Firm*—Knobbe, Martens, Olson & Bear LLP

[57] ABSTRACT

In accordance with the present invention, there is provided a control for an engine of a watercraft. The watercraft is preferably of the personal variety, and includes a water propulsion device which is driven by an output shaft of the engine. The engine has at least one combustion chamber, an intake system providing air to the combustion chamber, a fuel system providing fuel to the combustion chamber for combustion therein, and an ignition system including at least one ignition element associated with the combustion chamber. The watercraft engine control is of the type which does not include a main switch, but is arranged to turn on electrical systems of the engine when the engine is started and shut them off when the engine is stopped. The control includes a lanyard switch having first and second positions. In a first position the lanyard switch permits power to flow to the ignition element and the electrically-powered engine features, such as a fuel delivery mechanism. In a second position, however, the lanyard switch not only stops the engine by preventing the flow of power to ignition element but prevents power from flowing to the other electrically-powered features, such as the fuel delivery mechanism.

7 Claims, 6 Drawing Sheets

WATERCRAFT ENGINE CONTROL

RELATED APPLICATION DATA

This application is a continuation-in-part of U.S. patent application Ser. No. 08/977,264 filed Nov. 24, 1997, now abandoned and which claims priority to Japanese Application 8-327621 filed Nov. 22, 1996.

FIELD OF THE INVENTION

The present invention relates to a control for a watercraft engine. More particularly, the invention is a control which turns on and off electrically-powered systems relating to the engine, such as a fuel injection control, fuel pump and fuel pump control, when the engine is started and stopped.

BACKGROUND OF THE INVENTION

Watercraft are typically powered by an internal combustion engine which has its output shaft arranged to drive a water propulsion device of the watercraft. These engines are well known and typically operate on a two or four cycle principle.

These engines include a fuel system. The fuel system includes a pump or similar means for delivering fuel to a charge former which introduces fuel into air for combustion within a combustion chamber of the engine. In many instances, the charge former(s) comprises a fuel injector. In that instance, the fuel pump delivers fuel to the fuel injector under high pressure, this fuel delivered through the injector to the engine when the injector is turned on.

The watercraft includes a fuel pump control which controls the pump, whereby the pump delivers fuel to the engine at a sufficient rate. In addition, a fuel injector control is arranged to selectively power each fuel injector to turn it on and off for delivering fuel to the engine at an optimum time.

The engine also includes an ignition system for firing a spark plug or similar ignition element corresponding to each combustion chamber. An ignition control is provided for controlling the timing of the firing of each ignition element.

In the above-stated arrangement, power is provided to the various systems by a battery or charging coil. Often, there is no main switch provided for shutting off the power to all of the systems of the watercraft. When the watercraft is of the personal variety, it may include a lanyard switch is arranged to shut of power to the fuel injector for stopping the engine when the rider falls from the watercraft. Also, an ignition stop or "kill" switch may be provided whereby the rider may stop the engine by disrupting power to the ignition system of the engine. When either the stop switch or lanyard switch is thrown and the engine is stopped, however, power is still disadvantageously provided to some of the engine controls, such as the fuel pump and fuel injector controls, and to the fuel pump itself. In that instance, the battery may be drained of power even though the engine is not running.

An improved watercraft engine control for an engine powering a watercraft which does not include a main switch is desired.

SUMMARY OF THE INVENTION

In accordance with the present invention, there is provided a control for an engine of a watercraft. The watercraft is preferably of the personal variety, and includes a water propulsion device which is driven by an output shaft of the engine.

The engine has at least one combustion chamber. An intake system provides air to the combustion chamber. A fuel system provides fuel to the combustion chamber for combustion therein. Preferably, the fuel system includes an electronically operated fuel delivery mechanism. The engine also includes an ignition system including at least one ignition element associated with the combustion chamber.

The watercraft engine control is of the type which does not include a main switch. In the present invention, the control is arranged, however, to provide power to the engine electrical components when the engine is started and to shut them off when the engine is stopped.

Preferably, the control includes a lanyard switch having first and second positions. In the first position the lanyard switch permits power to flow to the ignition element, permitting starting of the engine, and permits power to flow to the other electrical system components, such as the fuel delivering mechanism. In the second position, however, the lanyard switch not only stops the engine by preventing the flow of power to ignition element, but prevents power from flowing either directly or indirectly, to one or more of the other electrical system components, such as the fuel delivery mechanism.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an engine control for a watercraft. In general, the engine control is arranged to turn on and off various electrically-powered systems relating to the engine of the watercraft, such as a fuel pump, a fuel injector control or the like when the engine is started or stopped. The control of the present invention is described for use with an engine powering a personal watercraft, since this is an application for which the invention has particular utility. Those of skill in the art will appreciate that the invention may be used or adapted for use in a variety of other settings.

Figure 1:
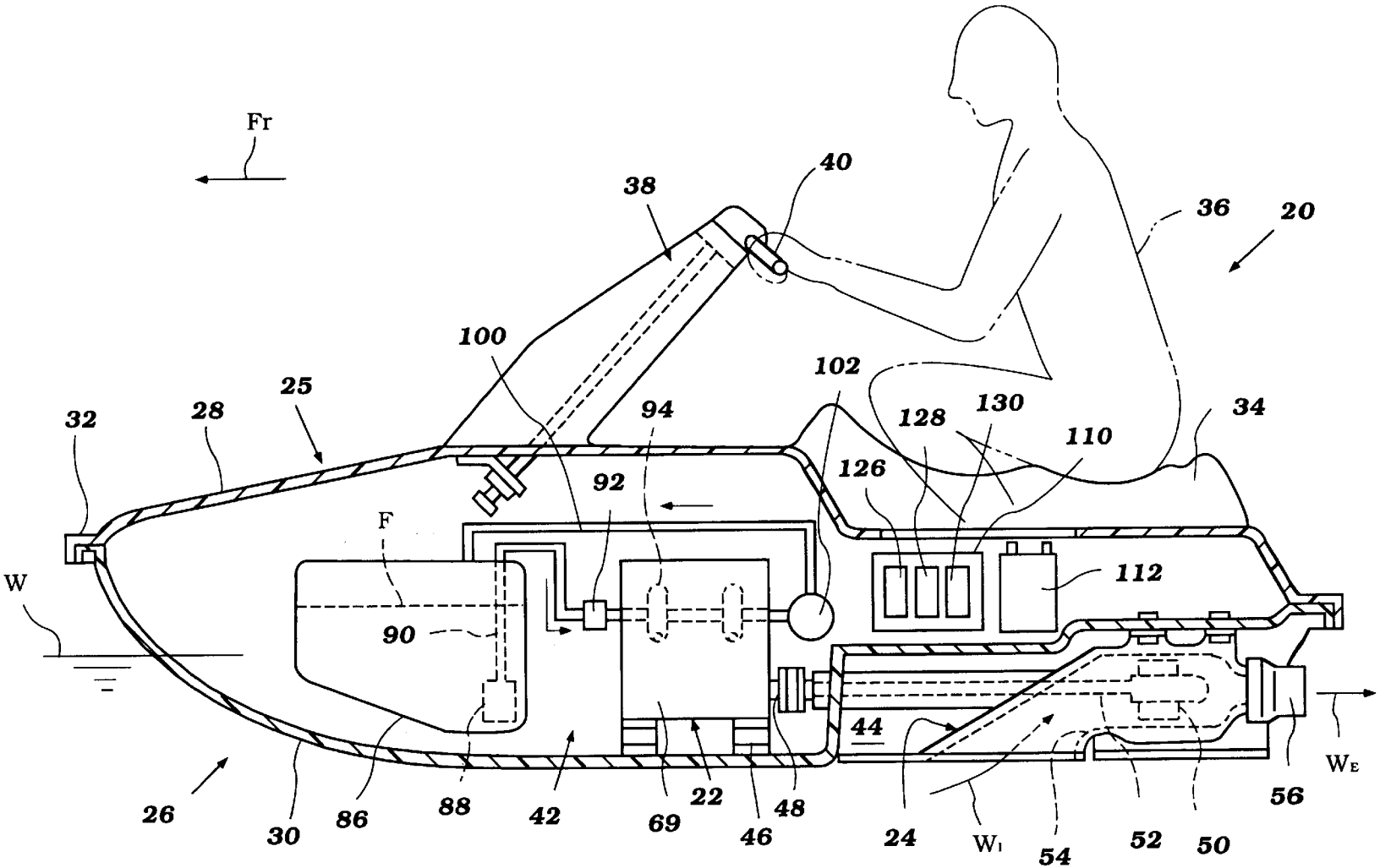
FIG. 1 is a cross-sectional side view of a personal watercraft powered by an engine and having an engine control in accordance with the present invention.
Figure 2:
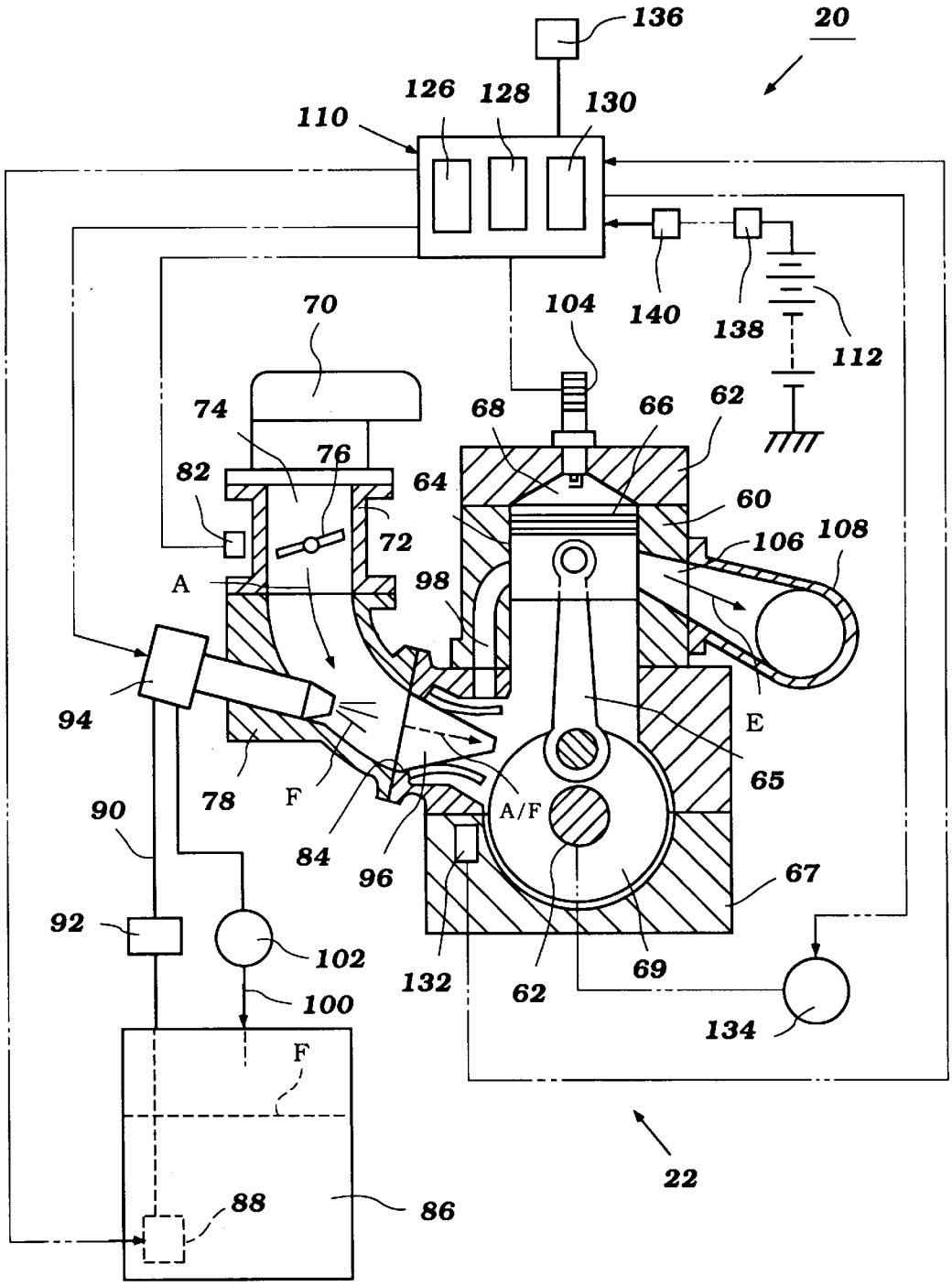
FIG. 2 is a cross-sectional view of the engine of the watercraft illustrated in FIG. 1 and further illustrating the engine control of the present invention.

FIGS. 1 and 2 illustrate a watercraft 20 having a watercraft body 25 comprising a hull 26 having a top portion or deck 28 and a lower portion 30. A gunnel 32 defines the intersection of the hull 26 and the deck 28. The hull 26 has a front end facing in the direction Fr.

A seat 34 is positioned on the top portion 28 of the hull 26 on which an operator 36 sits when operating the craft 20. A steering mechanism 38 including a steering handle 40 is provided adjacent the seat 32 for use by the operator 36 in directing the watercraft 20 in a manner described in more detail below.

The top and bottom portions 28,30 of the hull 26 cooperate to define an engine compartment 42 and a pumping area 44. An engine 22 is positioned in the engine compartment 42. The engine 22 is connected to the hull 26 via several engine mounts 46 connected to a bottom of the lower portion 30 of the hull 26.

The engine 22 has a crankshaft 48 which drives a water propulsion device of a propulsion unit 24 of the watercraft 20. Preferably, this water propulsion device is an impeller 50. The impeller 50 is connected to an impeller shaft 52 which is driven by the crankshaft 48, as illustrated in FIG. 1.

The propulsion unit 24 is positioned in the pumping area 44 and defines a propulsion passage 54 having an intake port which extends through the lower portion of the hull 28. Water W from the body of water in which the craft 20 is positioned is drawn in the direction $W_I$ into the intake port. The impeller 50 is positioned in the passage 54 and propels water therethrough to an outlet of the passage 54 at the stem of the watercraft 20. The outlet of the passage 54 is positioned within a steerable nozzle 56. The nozzle 56 is mounted for movement up and down and to the left and right for expelling water in a corresponding direction $W_E$, whereby the direction of the propulsion force for the watercraft 20 may be varied, and thus the direction the craft is traveling may b varied.

The engine 22 is best illustrated in FIG. 2. As illustrated therein, the engine 22 is preferably of the two-cylinder, two-cycle variety. Of course, the engine 22 may have as few as one, or more than two cylinders, and operate in accordance with other operating cycles, such as a four-cycle operating principle, as may be appreciated by one skilled in the art.

The engine 22 includes a cylinder block 60 having a cylinder head 62 connected thereto and cooperating therewith to define two cylinders 64. A piston 66 is movably mounted in each cylinder 64, and cooperates with the block 60 and head 62 to define a combustion chamber 68 corresponding to each cylinder. The piston 66 is connected to the crankshaft 48 via a connecting rod 65, as is well known in the art.

The crankshaft 48 is rotatably journalled by a number of sealed bearings with respect to the cylinder block 60 within a crankcase chamber 69. Preferably, the chamber 69 is defined by a crankcase cover member 67 which extends from a bottom portion of the cylinder block 60 opposite the cylinder head 62.

The engine 22 includes means for providing an air and fuel mixture to each combustion chamber 68. Preferably, an intake system is provided for delivering air for combustion to the engine. The intake system draws air A from within the engine compartment 42 (the air entering the engine compartment through one or more air inlets in the hull 26) into a silencer 70 and then selectively through a passage 74 through a throttle body 72.

A throttle valve 76 selectively controls the flow of air through the throttle body 72 to an intake pipe 78. The throttle valve 76 preferably comprises a butterfly-type plate movably positioned in the passage 74 through the body 72. The position of the valve 76 is remotely controllable by the operator of the watercraft 20. As illustrated, a throttle valve 76 position sensor 82 preferably provides throttle position sensor as described in more detail below.

The air which passes past the valve 76 flows through the intake pipe 78 and selectively through an intake port 84 leading into the crankcase chamber 69 in a manner described in more detail below. The chamber 69 is compartmentalized, with a crankcase chamber part provided corresponding to each cylinder 64, and an intake port 78 leading to each chamber part.

Preferably, a separate air flow path through a throttle body 72 and intake pipe 78 is provided corresponding to each cylinder 64, whereby a separate charge of air is supplied to each crankcase chamber part corresponding to each cylinder.

Fuel is provided to the incoming air. In particular, fuel is drawn from a fuel tank 86 (see FIGS. 1 and 2) positioned in the engine compartment 42 by a fuel pump 86 or similar means for delivering fuel. The pump 86 delivers fuel under high pressure through a delivery line 90. Preferably, a fuel filter 92 is positioned along the line 90.

The delivery line 90 extends to a charger former corresponding to each cylinder 64. Preferably, each charge former comprises a fuel injector 94. As best illustrated in FIG. 2, each injector is arranged to deliver fuel F into the air passing through the intake pipe 78.

The resultant air and fuel mixture (A/F) selectively passes through the intake port 84 into the crankcase chamber 69 as controlled by a reed valve 96, as is known in the art. The fuel and air charge within that portion of the crankcase chamber 69 corresponding to each cylinder 64 is delivered to its respective cylinder 64 through at least one scavenge passage 98 leading therefrom to the cylinder.

As is well known, in this arrangement, the reed valve 96 is arranged to open and permit an air and fuel charge to flow into the portion of the crankcase chamber 69 corresponding to a cylinder 64 when the piston 66 therein moves upwardly. When the piston 66 moves downwardly, the valve 96 closes and the charge therein is partially compressed before passing through the scavenge passage 98 into the cylinder 64 for combustion.

Preferably, the fuel system also includes a fuel return pipe or line 100 through which fuel which is delivered to the injectors 94 but not delivered to the engine 22 is returned to the fuel tank 86. A pressure regulated valve 102 is provided along the return line 100, maintaining the fuel at a high pressure in that part of the fuel system from which fuel is supplied to the injectors 94, but permitting the excess fuel to flow back to the fuel tank 86.

A suitable ignition system is provided for igniting the air and fuel mixture provided to each combustion chamber. Preferably, this system comprises a spark plug 104 (see FIG. 2) corresponding to each combustion chamber 68. The spark plugs 104 are preferably fired by a suitable ignition system, described in part below.

Exhaust gas generated by the engine 22 is routed from the engine to a point external to the watercraft 20 by an exhaust system which includes an exhaust passage or port 106 leading from each combustion chamber 68. An exhaust manifold 108 is connected to a side of the engine 22. The manifold 108 has a pair of branches with passages leading therethrough, these passages aligned with the passages 106 leading from the two cylinders 64.

The manifold 108 leads to a suitable exhaust system for routing the exhaust to a point external to the watercraft 20. Such exhaust systems are well known to those of skill in the art.

Means are provided for controlling the flow of exhaust gases through the exhaust passage 106 from each combustion chamber 64 in a timed manner. Preferably, this means comprises an exhaust control device such as a sliding knife-type or rotating valve and means for moving the valve (not shown).

The engine 22 includes a lubricating system for providing lubricating oil to the various moving parts thereof. Preferably, the lubricating system includes an oil tank or reservoir (not shown) from which lubricating oil is delivered and circulated throughout the engine, as is well known to those skilled in the art.

Figure 3:
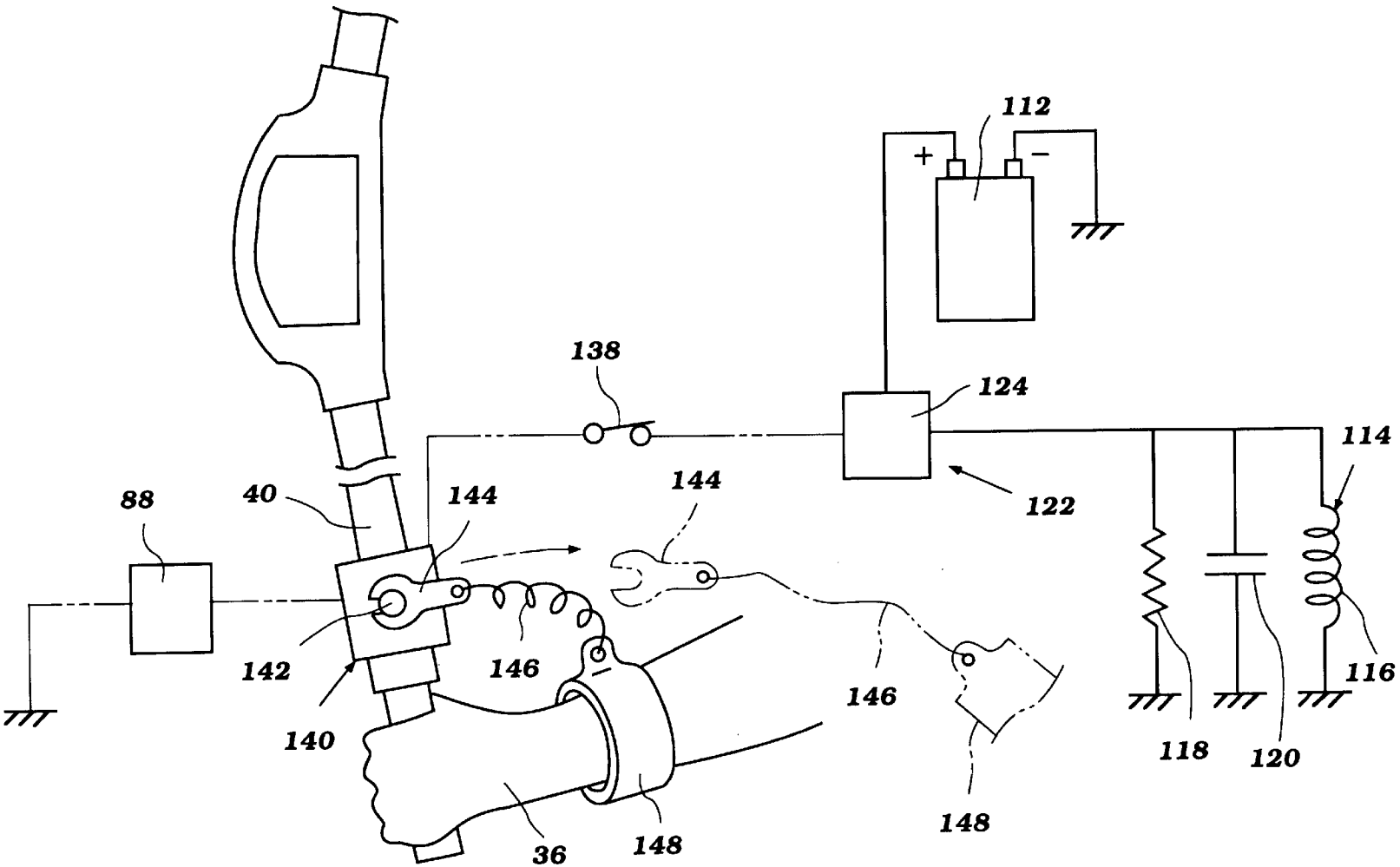
FIG. 3 schematically illustrates a portion of the engine control of the present invention.

A control is provided for controlling the engine. The control preferably includes an electrically-powered engine control (ECU) 120. Power is provided to the ECU 110 from either a battery 112 or an engine-driven generator 114. Power is provided to the ECU 110 by the battery 112 when the engine 22 is not running. When the engine 22 is running and the generator 114, which preferably includes a charging coil 116, resistor 118 and condenser 120, as known in the art, is generating power. As illustrated in FIG. 3, a switch 122, such as a transistor 124, is provided for controlling which power source provides power to ECU 110 and other electrically-powered elements of the engine. Preferably, the switch 122 is arranged so that the battery 112 provides the power when the generator 114 is not working, and the generator 114 when the engine is running and the generator 114 is generating power.

The ECU 110 preferably includes a fuel injector control 128, a fuel pump control 126, and an ignition control 130. Each of these controls 126,128,130 is powered by the power supply, such as the battery 112 or generator 114, in a manner described in detail below.

The fuel pump control 126 is arranged to selectively power the pump 88 for delivering fuel at the desired time and rate to the engine 22. The fuel injector control 128 is arranged to selectively power each fuel injector 94, opening and closing a valve associated with each injector 94 for delivering the fuel.

The ignition control 130 is arranged to fire each of the spark plugs 104 at a specific time.

As illustrated, the throttle sensor 82 is arranged to deliver a throttle position signal to the ECU 110. The ECU 110 utilizes the throttle position data to determine the amount of fuel which is delivered to the engine 22 by the fuel injectors 94, such as by changing the fuel injection duration with the fuel injector control 126.

A speed sensor 132 associated with the crankshaft 62 provides engine speed data to the ECU 110. The ignition control 130 of the ECU 110 utilizes this data to set the spark plug 104 firing timing, as known to those of skill in the art.

Preferably, the engine 22 is provided with a starter motor 134. The motor 134 has a pinion gear (not shown) which is arranged to engage a flywheel or similar toothed gear connected to the crankshaft 62, such that rotation of the starter motor gear effects rotation of the crankshaft 62, and thus starting of the engine 22.

The starter motor 134 is preferably powered when a starter switch 136 (see FIG. 2) is moved to an "ON" position. Preferably, the switch 136 remains in the "OFF" position at all other times such that except when the engine is being started the starter motor 134 is not powered.

In accordance with the present invention, the watercraft 20 is not provided with a single main switch which the rider 36 uses to turn on and off the engine and to start it. However, the watercraft control system is arranged so that power to the various electrically-powered systems, such as the fuel pump 88, fuel pump control 126 and/or fuel injector control 128 are shut off when the engine is shut off and are turned on when the engine is turned on.

Referring to FIGS. 2 and 3, a stop or "kill" switch 138 is preferably provided along the power circuit between the power source and the ECU 110. The stop switch 138 is arranged to be in the "ON" position (i.e. that position in FIG. 3 in which the circuit is closed and power is provided therethrough from the power source) during normal engine operating conditions. The operator of the craft 20 may elect to shut off the engine 22 by switching the stop switch 138 to the "OFF" position. In that event, power is disrupted to the ignition of the engine, causing it to stop running. In addition, however, when this switch 138 is moved to the "OFF" position, power is disrupted to the ECU 110, including the fuel pump 88 and fuel pump control 128, the fuel injector control 126 (and thus the fuel injectors 94). In this manner, no power flows to these systems even when the engine is not running, conserving power.

Still referring to FIGS. 2 and 3, the watercraft 20 includes a lanyard or similar safety switch 140. The lanyard switch 140 is preferably positioned along the circuit between the power source and the ECU 110. The lanyard switch 140 preferably includes a first contact element 142, such as a metal post, and a second element 144, such as a clamp, for selective engagement with the first element. The second element 144 is connected to the rider 36 of the craft 20 with a tether 146 leading to a strap or other element 148 which the rider wears.

In use, the rider 36 puts on the strap 148. The user then connects the second element 144 to the first element 142 to close the power circuit. When the rider 36 falls from the craft, as illustrated in phantom in FIG. 3, the tether 146 stretches until a force is transmitted therethrough from the strap 148 to the second element 144, pulling it from the first element 142, breaking the circuit.

When the circuit is broken, power is prevented from flowing from the power source to the engine systems such as the fuel pump 88, fuel pump control 126, fuel injector control 128, and ignition control 130. In this manner, not only is the engine shut off, but power is prevented from flowing to the ECU 110 and related controls 126,128,130 and the fuel pump 88 and the like, preventing power from draining from the battery 112.

Figure 4:
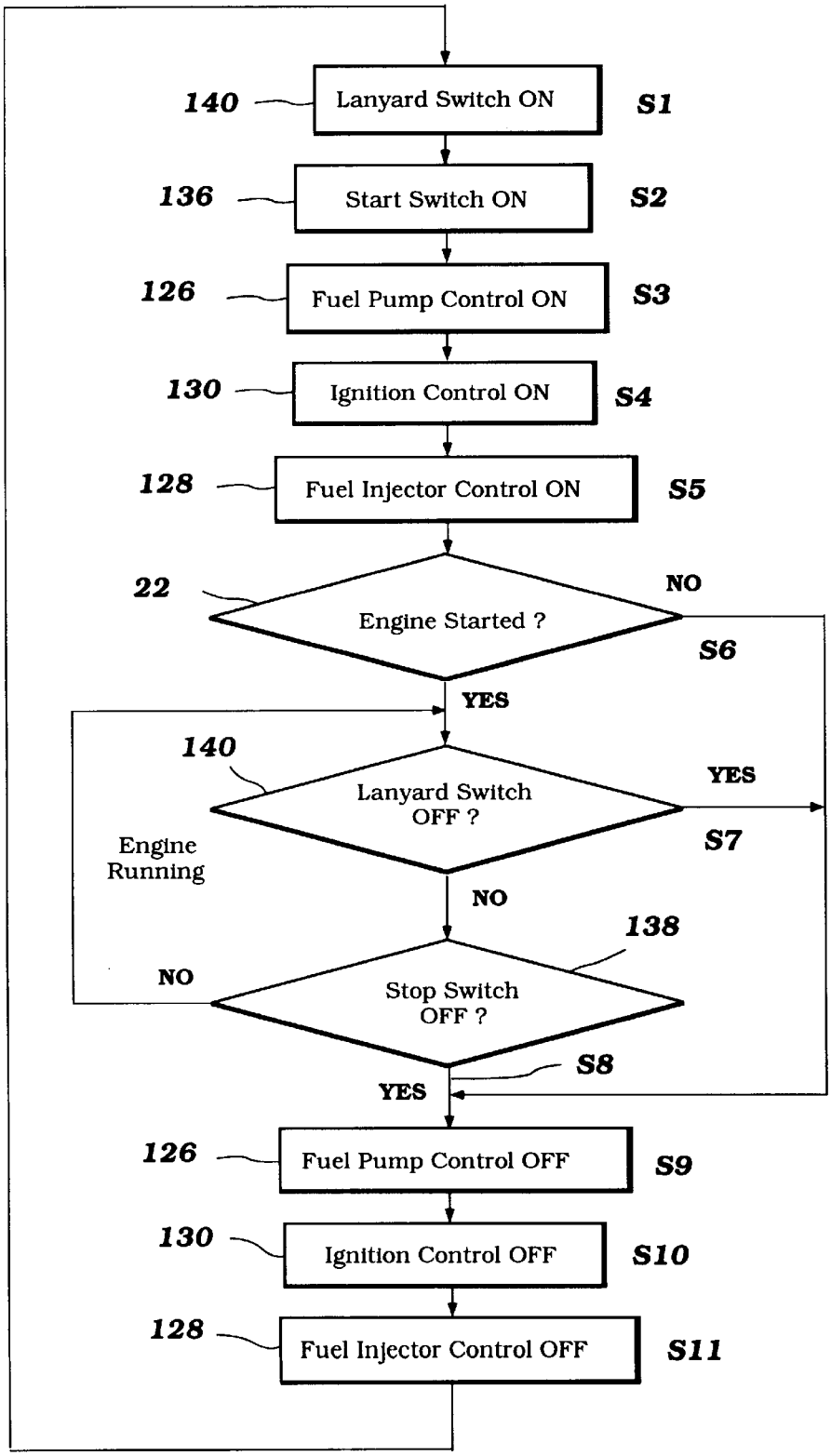
FIG. 4 is a flow chart of the engine control of the present invention.

FIG. 4 is a flow chart illustrating how the control of the watercraft engine 22 as described above operates. First, the rider 36 connects the second element 144 of the lanyard switch 140 to the first element 144, turning the switch "ON" (step S1). Then, the user turns the start switch 136 to the "ON" position, providing power to the starter motor 134 for starting the engine (step S2). At the same time, power is provided to the ECU 110 and its related controls and components, such as the fuel pump control 126, ignition control 130 and fuel injector control 128 (steps S3–5). If the engine 22 does not start (step S6), the power to these ECU 110 and related controls, including the fuel pump control 126, ignition control 130 and fuel injector control 128 (steps S9–11) are shut off.

If the engine starts (after step S5), the starter switch preferably automatically moves to the "OFF" position, preventing power from flowing to the starter motor 134 (not shown on in FIG. 4). In addition, the condition of the lanyard switch 140 is checked. If the rider 36 has fallen from the craft 20 or the like and the switch 140 has been disconnected (step S7), the power to these ECU 110 and related controls, including the fuel pump control 126, ignition control 130 and fuel injector control 128 (steps S9–11) are shut off.

If the lanyard switch 140 remains "ON" (i.e. connected), then the condition of the stop switch 138 is checked. If the stop switch 138 remains "ON" (i.e. closing the power circuit) then the engine remains running and the condition of the lanyard switch 140 is again checked and so on. In the event the stop switch 138 is moved to the "OFF" position (step S8), the power to these ECU 110 and related controls, including the fuel pump control 126, ignition control 130 and fuel injector control 128 (steps S9–11) are shut off.

In this fashion, the engine system features, including not only the ignition system but the fuel pump 88, fuel pump control 126 and fuel injector control 128, are all turned off when the lanyard switch 140 is off or the stop switch 138 is turned off and the engine is stopped.

In the above-described specific arrangement, when the lanyard switch 140 is moved to its OFF position, then power is prevented from flowing to all of the engine features. It should be understood that the lanyard switch 140 may be arranged, as discussed briefly above, to prevent power from flowing to only one or more of the engine features. For example, the circuit may be arranged so that when a lanyard switch 140 is moved to its OFF position, only the fuel pump control 126 or other fuel delivery control is shut off, but power may still flow to the ECU 110.

Figure 5:
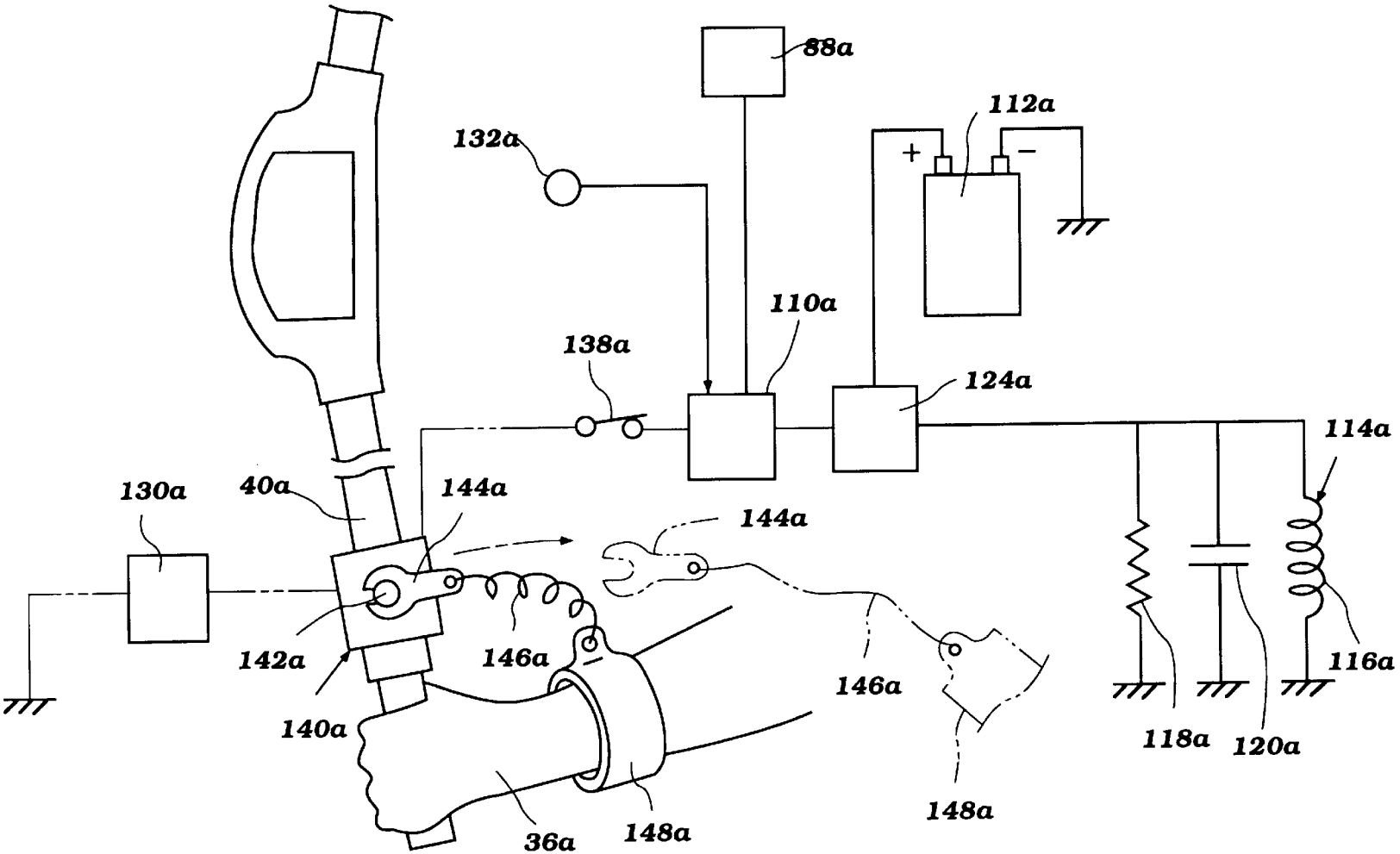
FIG. 5 schematically illustrates a portion of a second embodiment engine control of the present invention.

FIG. 5 illustrates a watercraft engine control in accordance with a second embodiment of the present invention. In general, this engine control is similar to the previous embodiment and is adapted for use with an engine and watercraft arranged as generally described above. As such, like reference numerals have been used with like or similar parts to those used in describing and illustrating the last embodiment, except that an "a" designator has been added to all of the reference numerals of this embodiment.

In this arrangement, and referring to FIG. 5, the lanyard switch 140*a* is arranged to shut off only the ignition system control 130*a*. When the engine stoppage condition is detected, such as from a crankshaft sensor 132*a* associated with the engine, the ECU 110*a* is arranged to shut off power to the remaining features, such as the fuel pump 88*a* (or other fuel system features such as the fuel injector control). In this arrangement, movement of the lanyard switch 140*a* to its OFF position thus prevents the flow of power to the fuel system indirectly.

In like fashion, the stop switch 138*a* in this embodiment is similarly arranged to shut of the engine, and thus the other engine features, like the lanyard switch 140*a* as described above.

Figure 6:
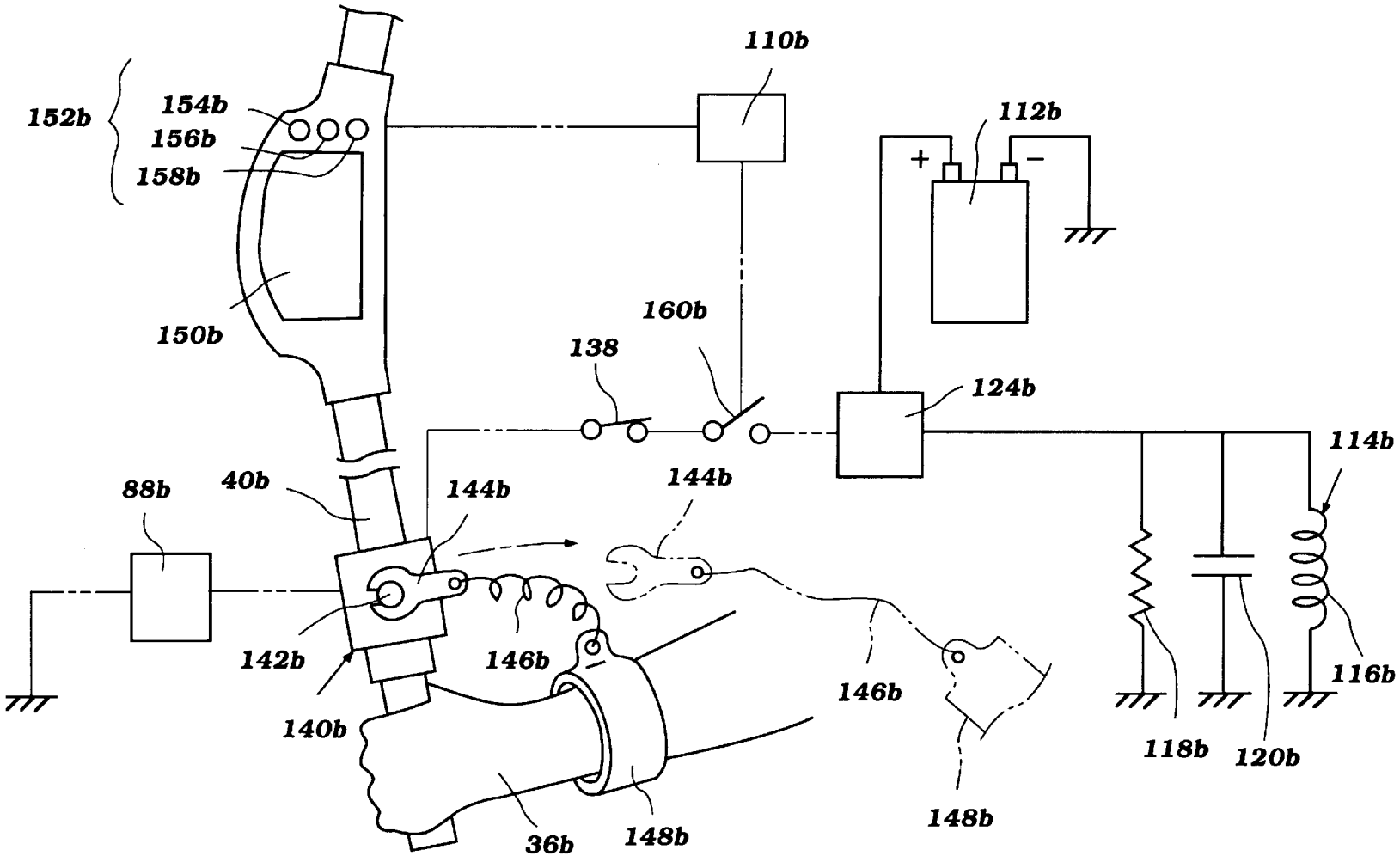
FIG. 6 schematically illustrates a portion of a third embodiment engine control of the present invention.

FIG. 6 illustrates a watercraft engine control in accordance with a third embodiment of the present invention. In general, this engine control is similar to the previous embodiments and is adapted for use with an engine and watercraft arranged as generally described above. As such, like reference numerals have been used with like or similar parts to those used in describing and illustrating the previous embodiments, except that a "b" designator has been added to all of the reference numerals of this embodiment.

In this embodiment, a control panel 150*b* is provided near the steering handle 40*b*. The control panel 150*b* may include a display for displaying engine speed (tachometer) or watercraft speed or the like. In addition, the control panel 150*b* includes a control area 152*b*. Preferably, the control area 152*b* includes one or more control buttons 154*b*,156*b*,158*b*.

The buttons 154*b*,156*b*,158*b* are arranged to selectively control a switch 160*b* which provides power to the ECU 110*b* and the related controls thereof. In particular, when the rider 36*b* wishes to operate the craft, he first engages the lanyard switch 140*b*. The rider 36*b* then pushes one or more of the buttons 154*b*,156*b*,158*b*, such as in a predetermined sequence, to throw the switch 160*b* and power the ECU 110*b* and related controls. Once the starter motor (not shown) has started the engine, the condition of the lanyard and stop switches 140*b*,138*b* are checked, as in the previous embodiment. If at any time these two switches are turned "OFF" (as in steps S7 or S8 of FIG. 4) then power is disrupted to the ECU 110*b* and its controls and the fuel pump 88*b* (as in steps S9–S11 of FIG. 4), such as by opening the switch 160*b*.

Of course, the foregoing description is that of preferred embodiments of the invention, and various changes and modifications may be made without departing from the spirit and scope of the invention, as defined by the appended claims.

What is claimed is:

1. A control for an engine of a watercraft, the watercraft having a water propulsion device and said engine having an output shaft arranged to drive said water propulsion device, said engine having at least one combustion chamber, an intake system for providing air to said combustion chamber and a fuel system for providing fuel to said combustion chamber for combustion therein, said fuel system including an electronically operated fuel delivery mechanism, and an ignition system including at least one ignition element associated with said combustion chamber, said control having a start operation switch for initiating the control of electrical power to at least said electronically operated fuel delivery mechanism with power from an electrical power source, said control including a lanyard switch having first and second positions, said lanyard switch in said first position permitting power to flow to said ignition element and said fuel delivery mechanism, said lanyard switch in said second position stopping said engine by preventing the flow of power to said ignition element regardless of the condition of said start operation switch, and including means for preventing power from flowing to said fuel delivery mechanism upon stopping of said engine and regardless of the condition of said start operation switch simultaneously disabling said ignition element and said fuel delivery mechanism.

2. The control in accordance with claim 1, wherein said means for preventing power includes an engine speed sensor for detecting stoppage of said engine.

3. The control in accordance with claim 1, wherein said fuel delivery mechanism comprises a fuel pump.

4. The control in accordance with claim 1, wherein said fuel delivery mechanism comprises a fuel injector.

5. The control in accordance with claim 1, wherein said start operation switch includes a stop switch moveable between a first position and a second position, wherein in said first position power is permitted to flow to said ignition element and said fuel delivery mechanism, and in said second position, power is prevented from flowing to said ignition element and fuel delivery mechanism.

6. The control in accordance with claim 1, wherein said control further includes a stop switch moveable between a first position and a second position, wherein in said first position power is permitted to flow to said ignition element and said fuel delivery mechanism, and in said second position, power is prevented from flowing to said ignition element and fuel delivery mechanism.

7. The control in accordance with claim 6, wherein said watercraft has a steering handle and said lanyard switch includes a first element connected to said watercraft handle and a second element worn by a rider of said watercraft, wherein said lanyard switch is in said first position when said second element engages said first element and is in said second position when said second element does not engage said first element.

* * * * *